US008528297B2

(12) United States Patent
Ceccotti et al.

(10) Patent No.: US 8,528,297 B2
(45) Date of Patent: Sep. 10, 2013

(54) METHOD FOR CONSTRUCTING A BUILDING USING CORNER PANELS

(75) Inventors: Ario Ceccotti, Vaglia (IT); Paolo Galletti, Calcinaia (IT); Daniele Maltinti, Cascina (IT)

(73) Assignees: Trentino Sviluppo S.p.A., Rovereto (IT); CNR Consiglio Nazionale Delle Richerche, Rome (IT)

( * ) Notice: Subject to any disclaimer, the term of this patent is extended or adjusted under 35 U.S.C. 154(b) by 245 days.

(21) Appl. No.: 12/864,014

(22) PCT Filed: Jan. 23, 2008

(86) PCT No.: PCT/IT2008/000035

§ 371 (c)(1),
(2), (4) Date: Jul. 22, 2010

(87) PCT Pub. No.: WO2009/093272

PCT Pub. Date: Jul. 30, 2009

(65) Prior Publication Data

US 2010/0293885 A1 Nov. 25, 2010

(51) Int. Cl.
*E04B 1/00* (2006.01)

(52) U.S. Cl.
USPC ..... 52/745.13

(58) Field of Classification Search
USPC ..... 52/234, 261, 264, 270, 271, 284, 52/745.1, 745.13, 79.1, 105
See application file for complete search history.

(56) References Cited

U.S. PATENT DOCUMENTS

| | | | | |
|---|---|---|---|---|
| 3,729,875 | A * | 5/1973 | Felson | 52/79.7 |
| 3,793,789 | A * | 2/1974 | Greenamyer | 52/463 |
| 4,894,963 | A * | 1/1990 | Campbell | 52/92.3 |
| 4,989,386 | A | 2/1991 | Collis | |
| 6,058,660 | A * | 5/2000 | Melton | 52/71 |
| 6,256,960 | B1 * | 7/2001 | Babcock et al. | 52/592.1 |
| 6,493,996 | B1 * | 12/2002 | Alexander et al. | 52/79.9 |
| 7,395,634 | B2 * | 7/2008 | Anderson et al. | 52/79.1 |
| 2012/0102847 | A1 * | 5/2012 | Kopp et al. | 52/79.1 |

FOREIGN PATENT DOCUMENTS

| | | |
|---|---|---|
| DE | 70 34 535 U | 7/1971 |
| DE | 28 15 227 A1 | 10/1979 |

* cited by examiner

*Primary Examiner* — Joshua J Michener
*Assistant Examiner* — Keith Minter
(74) *Attorney, Agent, or Firm* — Pearne & Gordon LLP

(57) ABSTRACT

A method for constructing a building comprises the steps of: preparing a base (1); connecting a plurality of panels (2) to the base (1) to form a plurality of walls of the building, each panel (2) at least partly forming a wall of the building; the step of connecting the plurality of panels (2) to the base (1) comprising the preliminary step of connecting a plurality of corner panels (5) at the corners of the base (1).

8 Claims, 2 Drawing Sheets

METHOD FOR CONSTRUCTING A BUILDING USING CORNER PANELS

TECHNICAL FIELD

The present invention relates to a method for constructing a building.

In particular, the present invention is applied in the construction of prefabricated buildings, preferably made of wood.

However, it should be noticed that the present invention may also be applied in the construction of prefabricated buildings made of different materials, such as multi-layer panels, panels made of concrete or other material.

BACKGROUND ART

There are prior art methods for constructing buildings, in particular wooden buildings, which comprise the step of connecting a plurality of flat panels, forming the walls, to a base which forms the floor of the building.

The panels may be cut and shaped in such a way that they include the openings that will be used for doors and windows, the roof slopes, joints and notches needed to assemble the building.

Prefabricated buildings are constructed starting with a traditional foundation on which the base is placed.

The panels are connected to the base to form the walls of the building. Suitable fixing means render the connection between the panels and between each panel and the base stable.

Once assembly of the panels forming the outer walls and, if present, the inner partition walls, is complete, another horizontal panel is put in position to form the ceiling of the building.

It should be noticed that said ceiling acts as a base for forming a floor of an additional story of the building, if the latter is present.

Disadvantageously, in the construction of buildings according to prior art methods, the flat panels must be effectively supported during the step of connecting them to the base.

Once a first panel has been connected to the base, it is absolutely essential that said panel is supported so that a second panel can be assembled, adjacent to the first.

Therefore, the prior art methods involve further steps of preparing suitable supporting structures, such as scaffolding, props or other equipment.

To at least partly overcome said disadvantages, use is often made of panels whose dimensions substantially match the wall to be set up. In that way, a single panel is handled, reducing the need for supporting structures.

However, it should be noticed that, since during the step of connecting flat panels the latter are not stably positioned, such prior art construction methods inevitably involve safety problems for the operators in charge of constructing the building.

DISCLOSURE OF THE INVENTION

In this context, the technical purpose of the present invention is to propose a method for constructing a building which is free of the above-mentioned disadvantages.

In particular, the present invention has for an aim to propose a method for constructing a building which can be easily and rapidly implemented.

A further aim of the present invention is to propose a method for constructing a building which is distinguished by a high level of safety in its implementation.

The technical purpose indicated and the aims specified are substantially achieved by a method for constructing a building described in one or more of the claims herein.

BRIEF DESCRIPTION OF THE DRAWINGS

Further features and advantages of the present invention are more apparent in the description below, with reference to a preferred, non-limiting, embodiment of a method for constructing a building, illustrated in the accompanying drawings, in which.

DETAILED DESCRIPTION OF THE PREFERRED EMBODIMENTS OF THE INVENTION

The following description refers to buildings made of wood. However, it should be noticed that the present invention may also be applied in connection with buildings made of other materials, such as, by way of example only, panels made of concrete, multi-layer panels or the like.

The method for constructing buildings in accordance with the present invention comprises first the step of preparing a base 1 which forms a floor of a building.

Figure 1:
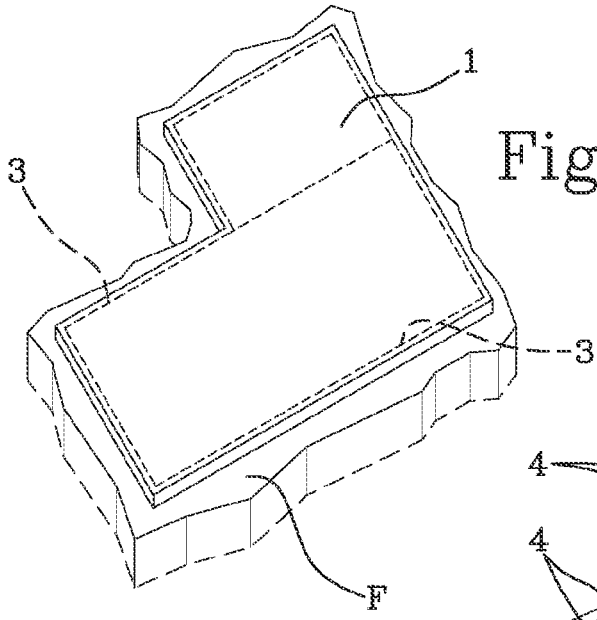
FIGS. 1 to 5 show separate and successive operating steps of a method for constructing a building in accordance with the present invention.

The base 1 is constrained to a building foundation "F" structure made in the known way (FIG. 1).

Once the base 1 has been prepared, a plurality of panels 2 is connected at right angles to the base 1 to form a plurality of walls of the building. In particular, each panel 2 at least partly forms one of the walls of the building. It should be noticed that the walls may be either supporting walls and/or partition walls for creating rooms inside the building.

Before application of the panels 2, markings 3 corresponding to the intended position of the walls are made on the base 1 (FIG. 1).

After the base 1 has been marked, the method comprises a step of applying a plurality of connecting elements 4 for stably connecting each panel 2 to the base 1.

In particular, the connecting elements 4 are fixed to the base 1 along the markings 3 made and using suitable anchor elements, of the known type and not illustrated.

Figure 2:
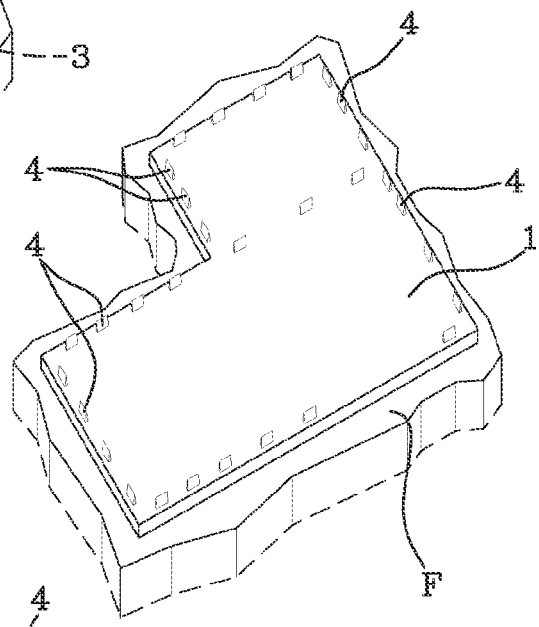

In more detail, the connecting elements 4 are fixed to the base 1 in such a way that they are spaced at a predetermined distance from one another (FIG. 2). The latter is determined at the building design step in accordance with the static and dynamic performance required of the building.

In the embodiment described, the step of fixing the connecting elements 4 is a carried out before the step of connecting the panels 2 to the base 1.

In this case, the panels 2 are connected to the base 1 by connecting each panel 2 to the connecting element 4 already stably fixed to the base 1.

In particular, each panel 2 has a cavity (not illustrated) made at a panel 2 base. Each panel 2 is lowered onto the corresponding connecting element 4 in such a way that the latter is housed in the cavity.

Finally, suitable fixing means (not illustrated) are connected between each panel 2 and the relative connecting element 4.

In an embodiment not illustrated, the connecting elements 4 are fixed after application of the panels 2.

In said case, the panels 2 are rested on the base 1 and are then fixed to the base 1 by application of the above-mentioned connecting elements 4. For example, in said case the connecting elements 4 may be "L"-shaped metal elements, brackets or other elements.

Figure 3:
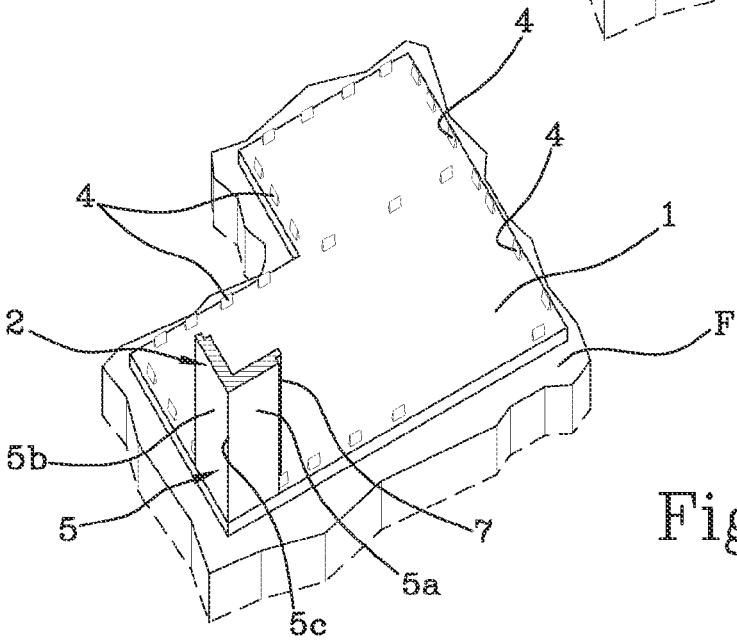
Figure 4:
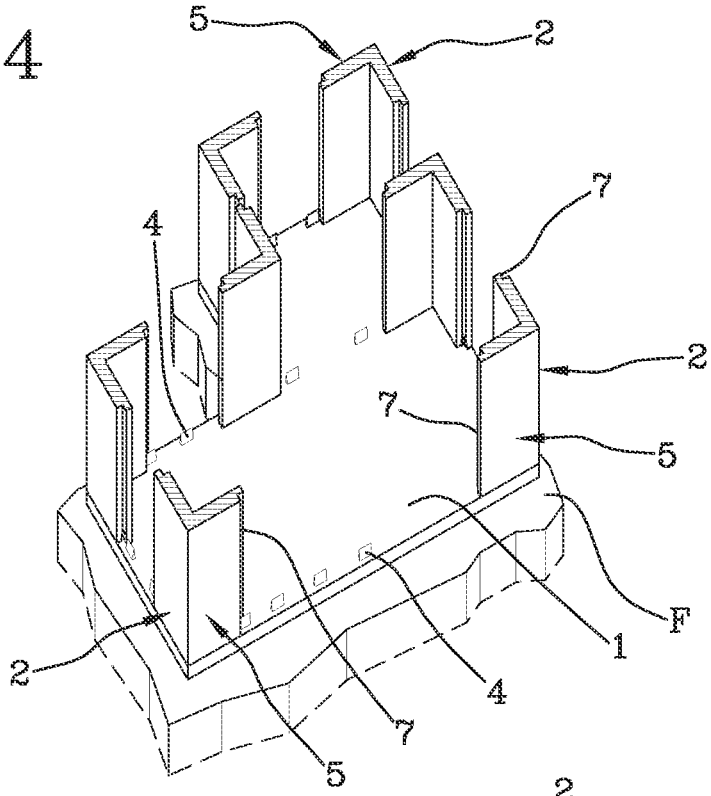

During the step of connecting the panels 2 to the base 1, a plurality of corner panels 5 is connected to the base 1 as a first step at a corresponding plurality of base 1 corners (FIGS. 3 and 4).

Said corner panel 5 comprises two portions 5*a*, 5*b* connected to one another at one edge 5*c* and set at an angle to each other in such a way that they form a corner equal to that of the base 1 which will be occupied by the corner panel 5.

In the embodiment described, each corner panel 5 has a substantially "L"-shaped cross-section and its portions 5*a*, 5*b* are substantially equal to one another.

In an alternative embodiment, the cross-section of the corner panel 5 has a different shape depending on the position where it must be mounted. For example, the corner panel 5 may have a substantially "T"-shaped cross-section.

Following connection of the corner panels 5, at least one flat panel 6 is connected between two successive corner panels 5.

Figure 5:
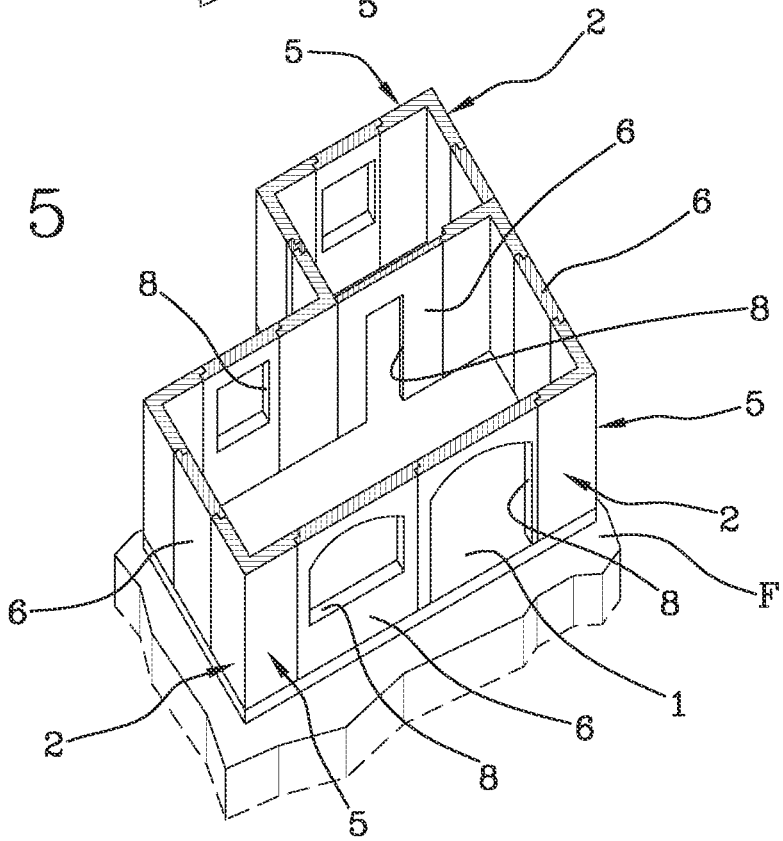

Depending on the distance separating two successive corner panels 5, a single flat panel 6 is connected or two or more flat panels 6 are put in position (FIG. 5).

In other words, the corner panels 5 only form part of the walls which are, therefore, completed by the flat panels 6.

It must be emphasised that the flat panels 6 are connected to the base 1 after all of the corner panels 5 have been connected to the base 1. The flat panels 6 are put in place only after said step.

Once connected to the base 1, each flat panel 6 is also fixed to a corresponding corner panel 5 adjacent to it.

For that purpose, both the corner panels 5 and the flat panels 6 have lateral profiles 7 respectively shaped to match one another to facilitate their connection.

In particular, the lateral profiles 7 of each panel 2 comprise a projection extending along the entire height of the panel 2 which in practice lies in contact against a corresponding contact surface made in the adjacent panel 2.

The panels 2 are fixed to one another using known means, for example self-tapping screws.

When all of the panels 2 have been connected and fixed to the base to form the lateral walls and, if necessary, internal partition walls, a cover (not illustrated in the accompanying drawings) is placed over the panels 2 and is stably fixed to the panels 2.

For example, said cover comprises the roof of the building.

Alternatively, the cover comprises an additional base which forms a floor of an upper story of the building.

On said additional base it is possible to repeat the method described in order to construct further walls for the upper story.

Said method is advantageously applied to construct a building which has a predetermined number of storeys.

In the embodiment described, the panels 2 are made of wood. In more detail, the panels 2 are made by drawing near successive layers made of wood with alternating orientation perpendicular to one another, thus giving the panels 2 the desired mechanical properties. If necessary, the flat panels 6 have openings 8 forming respective spaces for doors and/or windows.

The invention achieves the preset aims and brings important advantages.

Since they comprise two portions set at an angle to one another, the corner panels can stably maintain their position once connected to the base, even without the aid of suitable supporting structures.

In said case, subsequent connection of the flat panels is made much simpler, since each flat panel can be stably connected directly to the adjacent corner panel.

Therefore, even when mounting the flat panels there is no need to use special supporting structures.

Given the extreme simplicity of the connection of the flat panels, the latter may advantageously be made smaller and may be mounted in a modular fashion.

Making the flat panels smaller also allows them to be handled more easily, with advantages in terms of management of the space available on site.

Finally, since the panels are gradually mounted in a stable fashion, the safety of the operators in charge of constructing the building is also obviously improved.

The invention claimed is:

1. A method for constructing a building, comprising the steps of:

(a) preparing a building foundation structure;

(b) constraining a base to the building foundation structure, the base having a plurality of corners;

(c) at each corner of said plurality of corners, connecting a vertically-oriented corner panel to the base, each corner panel having at least two portions set at an angle to one another and connected to each other at one edge;

(d) between each pair of adjacent corner panels, connecting one or more vertically-oriented panels to the base to form a vertical wall of the building, each panel at least partly forming a vertical wall of the building;

wherein the method also comprises, after the base has been constrained to the building foundation structure, a step of making markings on the base which identify locations where bottoms of respective panels and corner panels will be fixed to the base, and, after said step of making markings on the base, mounting a plurality of connecting elements on the base along the markings, for connecting the panels and corner panels to the base; said connecting elements being fixed to the base along the markings in such a way that the connecting elements are spaced at a predetermined distance from one another determined at the building design step in accordance with a static and dynamic performance of the building.

2. The method according to claim 1, wherein each corner panel has a substantially L-shaped cross-section.

3. The method according to claim 1, wherein the method comprises connecting to the base at least one flat panel adjacent to at least one corner panel.

4. The method according to claim 3, wherein the flat panel is fixed to said at least one corner panel.

5. The method according to claim 3, wherein said at least one flat panel is connected to the base after said corner panels are connected to the base.

6. The method according to claim 3, wherein the connecting elements are mounted on the base before the one or more vertically-oriented panels and corner panels are connected to the base.

7. The method according to claim 3, wherein the connecting elements are mounted on the base after the one or more vertically-oriented panels and corner panels are applied to the base.

8. The method according to claim 1, wherein the two portions of each corner panel have the same height.

* * * * *